US005973795A

United States Patent [19]

Iida

[11] Patent Number: 5,973,795

[45] Date of Patent: Oct. 26, 1999

[54] TONER MARK FOR TONER CONCENTRATION CONTROL

[75] Inventor: Tetsuya Iida, Tokyo, Japan

[73] Assignee: NEC Corporation, Tokyo, Japan

[21] Appl. No.: 09/027,227

[22] Filed: Feb. 20, 1998

[30] Foreign Application Priority Data

Feb. 20, 1997 [JP] Japan ..... 9-035988

[51] Int. Cl.[6] ..... G03G 21/00

[52] U.S. Cl. ..... 358/459; 399/59

[58] Field of Search ..... 399/46, 48, 50, 399/59; 430/32; 358/459, 298

[56] References Cited

U.S. PATENT DOCUMENTS 5,339,150 8/1994 Hubble et al. ..... 355/326

5,546,170 8/1996 Ohba et al. ..... 355/246

5,767,888 6/1998 Schleusener et al. ..... 347/130

FOREIGN PATENT DOCUMENTS 62-50818 10/1987 Japan .

*Primary Examiner*—John Goodrow

*Attorney, Agent, or Firm*—Sughrue, Mion, Zinn, Macpeak & Seas, PLLC

[57] ABSTRACT

A toner mark which is to be sensed by a toner concentration sensor in an electrophotographic printing apparatus includes a rectangular dot pattern where a plurality of toner dot patterns are spaced in a staggered configuration. Each of the toner dot patterns is formed in line which is angled with respect to a width direction of the toner mark. Further, any line along a width direction of the toner mark crosses at least one toner dot pattern.

17 Claims, 4 Drawing Sheets

TONER MARK FOR TONER CONCENTRATION CONTROL

BACKGROUND OF THE INVENTION

1. Field of the Invention

The present invention generally relates to a toner concentration control mark and in particular to a toner mark which is used to adjust toner or density in an electrophotographic printing machine.

2. Description of the Related Art

In electrophotographic printing machines such as laser printers, there may be cases where a toner concentration mark is printed on an end of a paper. In such a case, a toner concentration detector is provided to detect the toner density of the mark which is used to adjust the amount of toner supply in a developing unit in order to keep the print quality constant. Therefore, it is necessary for the toner concentration mark to precisely reflect the density of a printed image.

Such a toner concentration mark has been disclosed in Japanese Patent Examined Publication No. 62-50818. The toner concentration mark consists of a concentration control mark and an auxiliary mark which is placed before the concentration control mark. The concentration control mark is used to detect the toner concentration.

The auxiliary mark causes the well-known edge effect to be reduced. However, the detection output of the concentration control mark is not always stable because of deteriorated photosensitive drum, worn transfer unit, or other problems. Therefore, there may be developed cases where the toner concentration control is not properly performed.

SUMMARY OF THE INVENTION

An object of the present invention is to provide a toner mark which can achieve precise toner concentration control unaffected by deterioration of print quality.

According to an aspect of the present invention, a toner mark is comprised of a plurality of toner patterns arranged such that the toner patterns are spaced in a staggered configuration and each of the toner patterns is formed in line which is angled with respect to a width direction of the toner mark.

Each of the toner patterns may be one of a first toner pattern inclined 45 degrees and a second toner pattern inclined 135 degrees. Further, any line along the width direction may cross at least one of the toner patterns.

According to another aspect of the present invention, a toner mark provided to be detected by a toner concentration sensor in an electrophotographic printing apparatus is comprised of a rectangular pattern of a first number of dots wide by a second number of dots high where a plurality of toner dot patterns are arranged such that the toner dot patterns are spaced in a staggered configuration and each of the toner dot patterns is formed in line which is angled with respect to a width direction of the toner mark. Each of the toner dot patterns may be a predetermined number or less of dots thick, wherein the predetermined number is smaller than a minimum number which causes edge effect in the electrophotographic printing apparatus. Further, the first number may be set to more than a sensitive width of the toner concentration sensor.

DETAILED DESCRIPTION OF THE PREFERRED EMBODIMENTS

Figure 1:
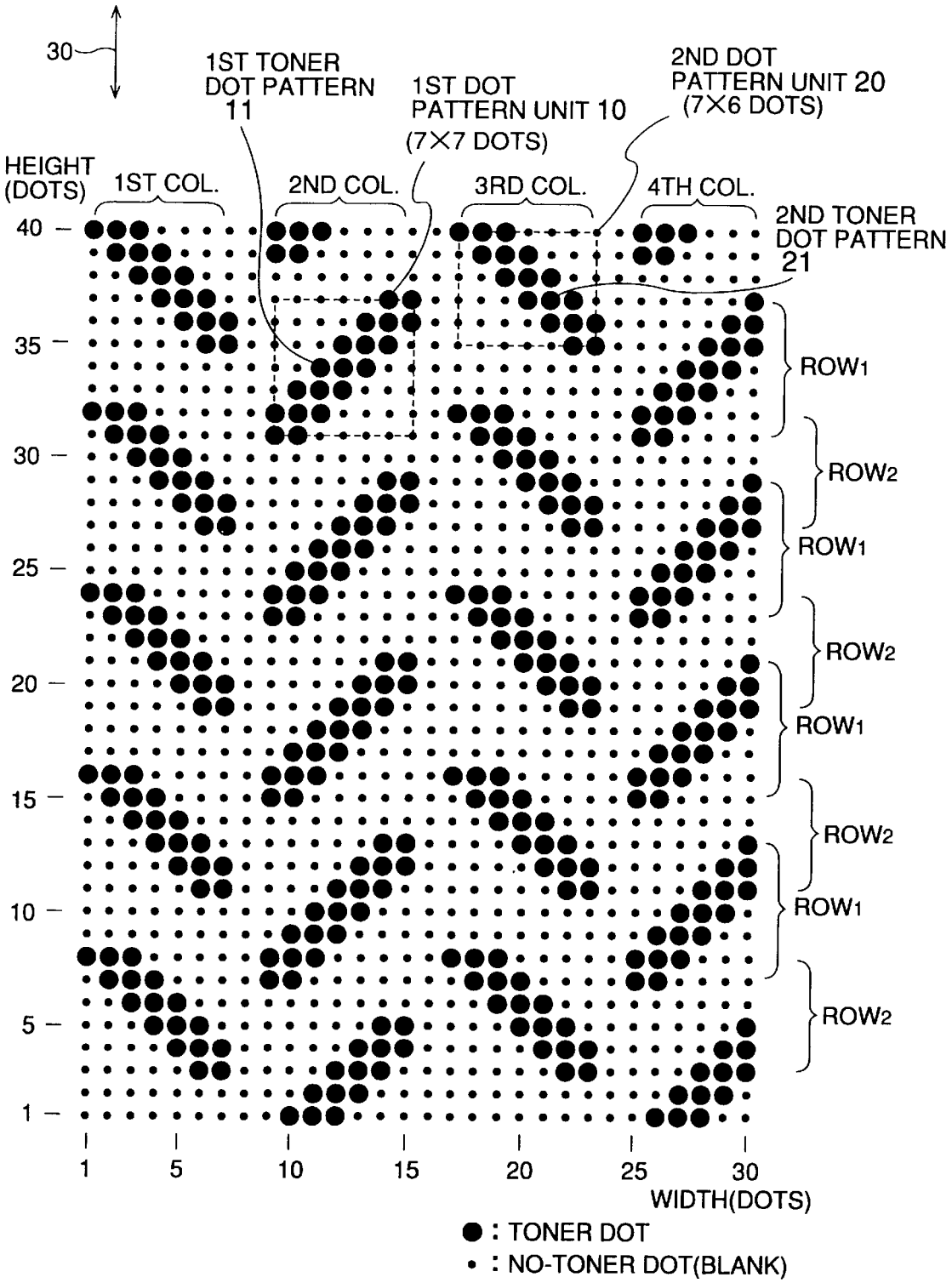
FIG. 1 is a diagram showing a toner pattern of toner concentration mark according to a first embodiment of the present invention.

Referring to FIG. 1, a toner concentration mark is formed from a rectangular pattern of 30 dots wide by 40 dots high. The width of the toner concentration mark is longer than the minimum sensitive width of a toner concentration sensor so as to accommodate deflections of paper which is carried along an arrow 30.

The toner concentration mark includes two different dot pattern units 10 and 20. The first dot pattern unit 10 is formed from a 7 by 7 matrix of dots where a first toner dot pattern 11 is formed with the angle of inclination of 45 degrees with respect to a line along the width. The second dot pattern unit 20 is formed from a 7 by 6 matrix of dots where a second toner dot pattern 21 is formed with the angle of inclination of 135 degrees with respect to the line along the width. The first and second toner dot patterns 11 and 21 are both three dots or less thick in width and height directions.

In this embodiment, the toner concentration mark includes four columns each having a width of 7 dots with a one-dot spacing between them. More specifically, the first column is formed in a range from the $1^{st}$ to the $7^{th}$ dots in the width direction, the second column from the $9^{th}$ to the $15^{th}$ dots, the third column from the $17^{th}$ to the $23^{rd}$ dots, and the fourth column from the $25^{th}$ to the last dots.

Each column has a dot pattern unit spaced every one or two dots. More specifically, each of the first and third columns has the second dot pattern unit 20 spaced every two dots. Therefore, in each of the first and third columns, the second toner dot pattern 21 is spaced every 5 dots. Similarly, each of the second and fourth columns has the first dot pattern unit 10 spaced every one dot. Therefore, in each of the second and fourth columns, the first toner dot pattern 11 is spaced every 6 dots. In other words, the first to fourth columns alternate between the first toner dot patterns and the second toner dot patterns.

Further, the dot pattern units of each column deviate from those of the adjacent column by an approximate half of unit height. From another point of view, the toner concentration mark also has a first row $ROW_1$ spaced every one dot and a second row $ROW_2$ spaced every two dots. The first row $ROW_1$ and the second row $ROW_2$ are respectively shifted in position by an approximate half of dot pattern unit (here, three dots). Therefore, the first row $ROW_1$ and the second row $ROW_2$ are partially overlapped and thereby at least one toner dot exists on a line along the width, which causes avoiding abrupt variations in the number of toner dots when scanning in the direction of the arrow 30.

In this manner, in any two adjacent columns, the toner dot pattern 11 and the second toner dot pattern 21 are spaced in a staggered configuration. Such a toner concentration mark is hardly affected by deterioration of the photosensitive drum and other components, resulting in precise toner concentration sensing and control.

Figure 2:
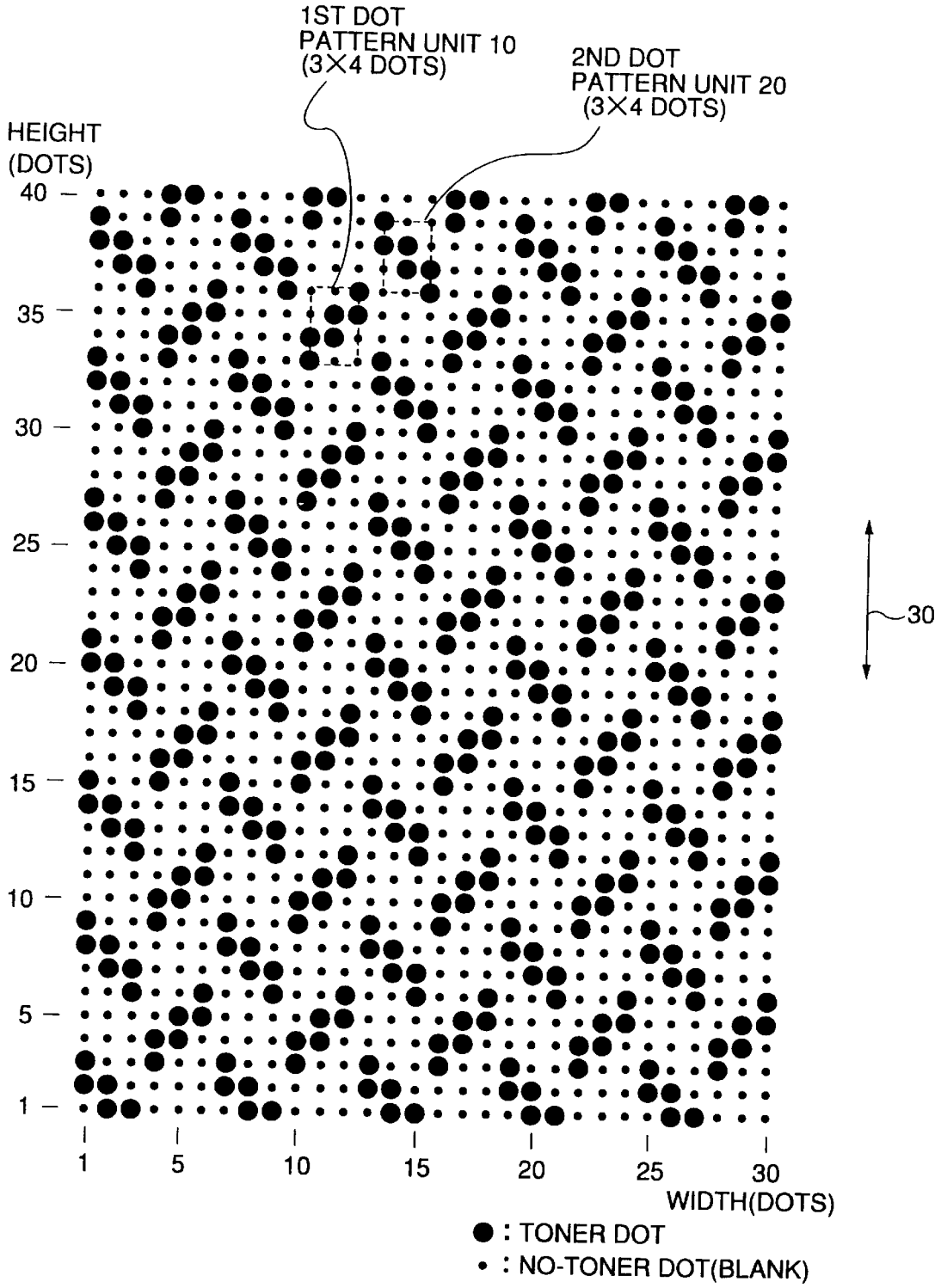
FIG. 2 is a diagram showing a toner pattern of toner concentration mark according to a second embodiment of the present invention.

Referring to FIG. 2, there is shown another toner concentration mark which is formed from a rectangular pattern of 30 dots wide by 40 dots high. As in the case of the first embodiment, the width of the toner concentration mark is longer than the minimum sensitive width of a toner concentration sensor so as to accommodate deflections of paper which is carried along an arrow 30.

The toner concentration mark includes a first dot pattern unit 10 which is formed from a 3 by 4 matrix of dots where a first toner dot pattern is formed with the angle of inclination of 45 degrees and a second dot pattern unit 20 which is formed from a 3 by 4 matrix of dots where a second toner dot pattern is formed with the angle of inclination of 135 degrees. The first and second toner dot patterns are both two dots or less thick in width and height directions.

Each column has a dot pattern unit spaced every two dots where a corresponding toner dot pattern is spaced every 4 dots. Further, the dot pattern units of each column deviate from those of the adjacent column so that adjacent toner dot patterns are partially overlapped. Therefore, at least one toner dot exists on a line along the width, which causes avoiding abrupt variations in the number of toner dots when scanning in the direction of the arrow 30.

In this manner in any two adjacent columns, the toner dot pattern and the second toner dot pattern are spaced in a staggered configuration. As described before, such a toner concentration mark is hardly affected by deterioration of the photosensitive drum and other components, resulting in precise toner concentration sensing and control.

The present invention is not limited to the above embodiments as shown in FIGS. 1 and 2. There may be also possible a toner concentration mark which has a plurality of toner dot patterns spaced so that no blink line exists across the toner concentration mark in width direction and the numbers of toner dots of each toner dot pattern in width and height directions are smaller than the minimum number which causes the edge effect. Therefore, a toner concentration mark is possible which has a single type of toner dot pattern spaced at the angle of inclination of 45 or 135 degrees.

Figure 3:
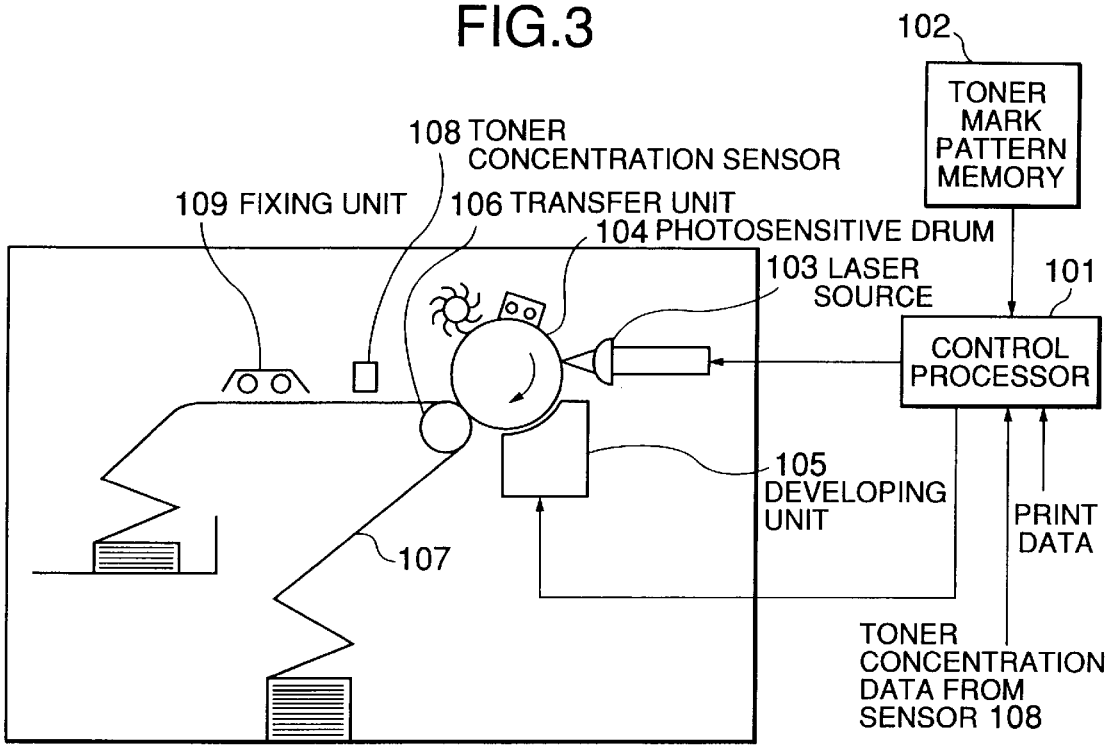
FIG. 3 is a block diagram showing an example of toner concentration control system.
Figure 4:
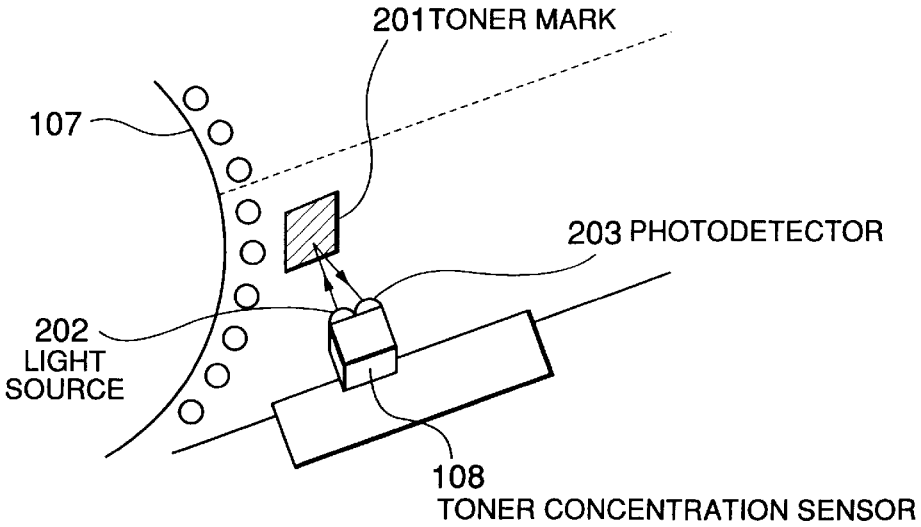
FIG. 4 is a perspective view showing an arrangement around a toner concentration sensor.

Referring to FIGS. 3 and 4, a control processor 101 of a laser printer reads toner mark pattern data from a toner mark pattern memory 102 and controls a laser source 103 according to the toner mark pattern data. The scan of a laser beam forms a latent image of the toner concentration mark at a predetermined position on a photosensitive drum 104. The latent image is developed by a developer supplied from a developing unit 105 and then the developed image is transferred from the photosensitive drum 104 to a continuous fanfold paper 107 by a transfer unit 106. A toner concentration mark 201 on the paper 107 is sensed by a toner concentration sensor 108 and is fixed by a fixing unit 109.

When receiving toner concentration data from the toner concentration sensor 108, the control processor 101 controls the developing unit 105 so as to keep the toner concentration constant. The control processor 101 further adjusts the toner concentration sensor 108 so that the sensor output is initialized.

As shown in FIG. 4, the toner concentration sensor 108 is placed at a position corresponding to the toner concentration mark 201 formed on the paper 107. The toner concentration sensor 108 is comprised of a light source 202 and a photo detector 203. The light emitted from the light source 202 is reflected off the surface of the toner concentration mark 201 formed on the paper 107. The photo detector 203 detects the reflected light to produce a voltage corresponding to the toner density of the toner concentration mark 201. Since the width of the mark 201 is longer than the sensitive width of the toner concentration sensor 108, reliable toner concentration sensing can be achieved when the mark 201 is somewhat deviated from the proper position.

Figure 5:
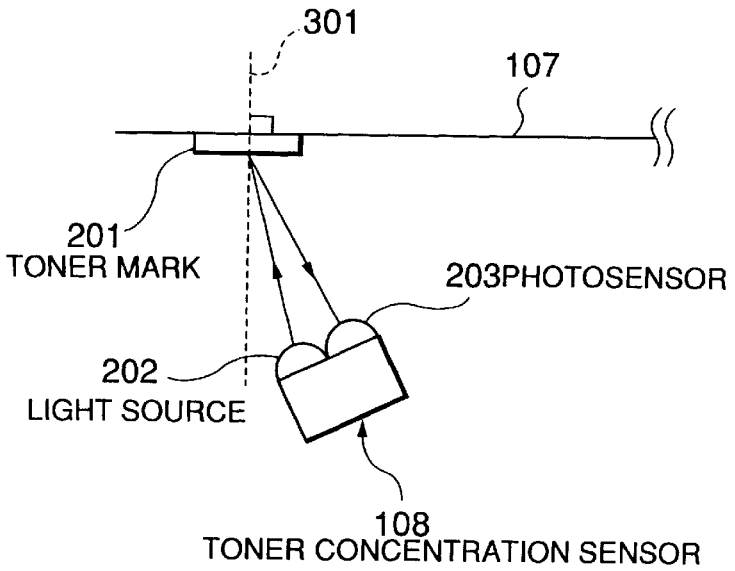
FIG. 5 is a plan view showing another arrangement around a toner concentration sensor.

Referring to FIG. 5, the toner concentration sensor 108 may be placed at a position deviated from the center axis 301 of the mark 201. In this arrangement, the mark 201 is illuminated at an angle. Therefore, the toner of the mark 201 adhering to the paper 107 casts a shadow over the mark 201. Since the mark 201 according to the present invention has a plurality of toner dot patterns spaced, the toner concentration data is not affected by the shadow.

Figure 6:
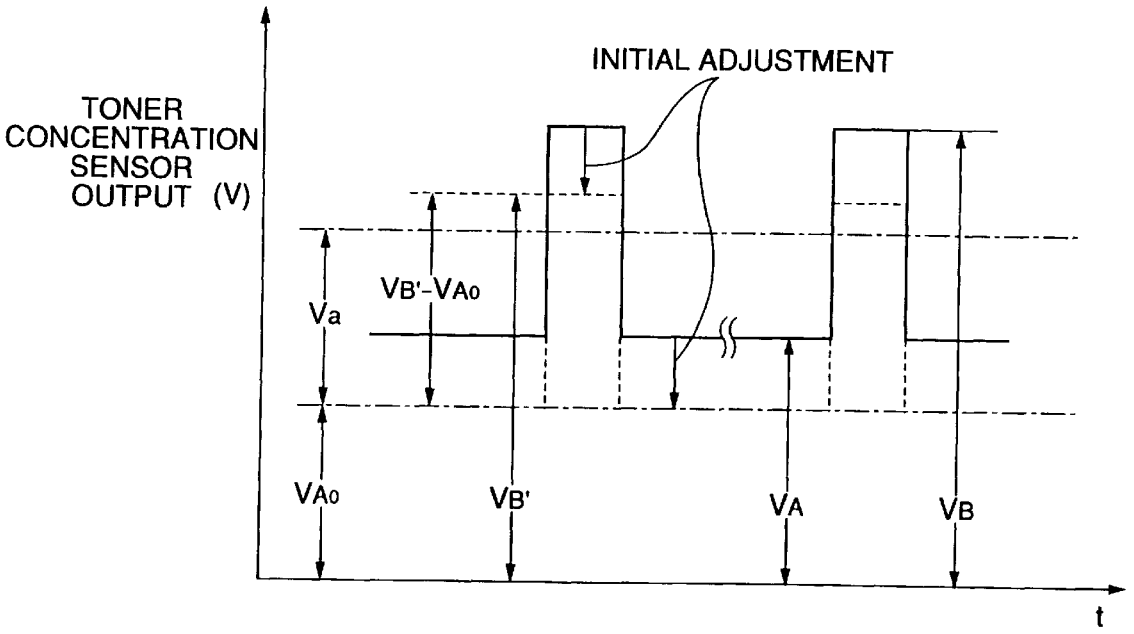
FIG. 6 is a time chart showing a wave form of output voltage of the toner concentration sensor.

Referring to FIG. 6, a lower voltage $V_A$ is output when the light source 202 illuminates surfaces other than the toner concentration mark 201. On the other hand, a higher voltage $V_B$ is output when the light source 202 illuminates the toner concentration mark 201. When receiving these initial output voltages $V_A$ and $V_B$, the control processor 101 controls the light intensity of the light source 202 so that the initial voltage $V_A$ is equal to a reference voltage $V_{A0}$ which is obtained from a reference paper (for example, 55 kgNIP paper). After the adjustment of light intensity, the adjusted output voltages $V_{A0}$ and $V_B'$ are obtained and the difference between the voltages $V_{A0}$ and $V_B'$ is used to determine the toner concentration. The control processor 101 controls the developing unit 105 so that the difference $V_B'-V_{A0}$ is kept at a constant value Va.

What is claimed is:

1. A toner mark for toner concentration control, comprising:

a plurality of toner patterns arranged such that the toner patterns are spaced in a staggered configuration and each of the toner patterns is formed in line which is angled with respect to a width direction of the toner mark.

2. The toner mark according to claim 1, wherein each of the toner patterns is one of a first toner pattern inclined 45 degrees and a second toner pattern inclined 135 degrees.

3. The toner mark according to claim 2, wherein the toner patterns alternate between the first toner pattern and the second toner pattern in the width direction.

4. The toner mark according to claim 2, wherein the toner patterns are divided into a plurality of columns which alternate between the first toner pattern and the second toner pattern, wherein the first toner pattern and the second toner pattern are spaced in any two adjacent columns in the staggered configuration.

5. The toner mark according to claim 1, wherein any line along the width direction crosses at least one of the toner patterns.

6. The toner mark according to claim 5, wherein each of the toner patterns is one of a first toner pattern and a second toner pattern.

7. The toner mark according to claim 6, wherein the toner patterns alternate between the first toner pattern and the second toner pattern in the width direction.

8. The toner mark according to claim 6, wherein the toner patterns are divided into a plurality of columns which alternate between the first toner pattern and the second toner pattern, wherein the first toner pattern and the second toner pattern are spaced in any two adjacent columns in the staggered configuration.

9. A toner mark provided to be detected by a toner concentration sensor in an electrophotographic printing apparatus, comprising:

a rectangular pattern of a first number of dots wide by a second number of dots high where a plurality of toner dot patterns are arranged such that the toner dot patterns are spaced in a staggered configuration and each of the toner dot patterns is formed in line which is angled with respect to a width direction of the toner mark.

10. The toner mark according to claim 9, wherein each of the toner dot patterns is a predetermined number or less of dots thick, wherein the predetermined number is smaller than a minimum number which causes edge effect in the electrophotographic printing apparatus.

11. The toner mark according to claim 9, wherein the first number is set to more than a sensitive width of the toner concentration sensor.

12. The toner mark according to claim 9, wherein the toner mark is formed at a predetermined position on a recording medium.

13. A toner concentration control system in an electrophotographic printing apparatus, comprising:

a toner concentration sensor for sensing a reflected light which is reflected off a toner mark; and a controller for controlling a developing unit of the electrophotographic printing apparatus based on an output of the toner concentration sensor so as to keep toner concentration at a predetermined level, wherein the toner mark comprises a plurality of toner patterns arranged such that the toner patterns are spaced in a staggered configuration and each of the toner patterns is formed in line which is angled with respect to a width direction of the toner mark.

14. The toner concentration control system according to claim 13, wherein each of the toner patterns is one of a first toner pattern inclined 45 degrees and a second toner pattern inclined 135 degrees.

15. The toner concentration control system according to claim 14, wherein the toner patterns alternate between the first toner pattern and the second toner pattern in the width direction.

16. The toner concentration control system according to claim 13, wherein any line along the width direction crosses at least one of the toner patterns.

17. A toner concentration control method in an electrophotographic printing apparatus, comprising the steps of:

sensing a reflected light which is reflected off a toner mark which comprises a plurality of toner patterns arranged such that the toner patterns are spaced in a staggered configuration and each of the toner patterns is formed in line which is angled with respect to a width direction of the toner mark; and controlling a developing unit of the electrophotographic printing apparatus based on a sensed reflected light so as to keep toner concentration at a predetermined level.

* * * * *